US005457846A

United States Patent [19]

Kuwano et al.

[11] Patent Number: 5,457,846

[45] Date of Patent: Oct. 17, 1995

[54] PORTABLE POWER BLOWER

[75] Inventors: Michiyasu Kuwano, Fuchu; Yoshikazu Iida, Tokyo, both of Japan

[73] Assignee: Kioritz Corporation, Ohme, Japan

[21] Appl. No.: 176,473

[22] Filed: Jan. 3, 1994

[30] Foreign Application Priority Data

Jan. 21, 1993 [JP] Japan ..... 5-001226 U

[51] Int. Cl.[6] ..... A47L 5/36

[52] U.S. Cl. ..... 15/339; 15/326; 15/344; 15/405; 15/422

[58] Field of Search ..... 15/344, 405, 339, 15/422, 326

[56] References Cited

U.S. PATENT DOCUMENTS

| | | | |
|---|---|---|---|
| 4,223,419 | 9/1980 | Sato . | |
| 4,517,939 | 5/1985 | Kiyooka . | |
| 4,644,606 | 2/1987 | Luerken et al. . | |
| 4,674,146 | 6/1987 | Tuggle et al. | 15/405 X |
| 4,694,528 | 9/1987 | Comer et al. | 15/344 X |
| 4,792,286 | 12/1988 | Gassen . | |
| 4,872,308 | 10/1989 | Nagai et al. . | |
| 4,913,112 | 4/1990 | Iida . | |
| 5,011,058 | 4/1991 | Sapp et al. . | |
| 5,052,073 | 10/1991 | Iida | 15/327.5 |
| 5,176,303 | 1/1993 | Franke . | |
| 5,178,312 | 1/1993 | Iida . | |
| 5,195,208 | 3/1993 | Yamami et al. | 15/327.5 X |
| 5,222,275 | 6/1993 | Baker et al. | 15/344 X |
| 5,233,946 | 8/1993 | Yamami | 15/344 X |

*Primary Examiner*—Christopher K. Moore
*Attorney, Agent, or Firm*—Cushman Darby & Cushman

[57] ABSTRACT

A portable power blower includes a body and a handle mounted on a top of the body. The body includes a prime mover, a fan volute chamber, a fan housed in the fan volute chamber and attached to one end of an output shaft of the prime mover, and an air inlet of the fan volute chamber formed in front of the fan. A main guard member is so mounted as to cover one side surface of the fan volute chamber on which the air inlet is formed, and a gap for radially introducing external air into the air inlet is formed between a rear side of the main guard member and the one side surface. The gap is in open communication with atmosphere at a top portion of the body. A bottom guard member connected to the main guard member and the fan volute chamber covers bottom portions of the fan volute chamber and the prime mover, and a sub-guard member connected to the bottom guard member and the fan volute chamber covers sides of the prime mover which oppose the main guard member and the bottom guard member, respectively.

2 Claims, 2 Drawing Sheets

PORTABLE POWER BLOWER

BACKGROUND OF THE INVENTION

1. Field of the Invention

The present invention relates to a portable power blower used in scavengery or the like. More particularly, it relates to a portable power blower which comprises, as a power source, a prime mover such as an air-cooled two-cycle internal combustion engine and which is adapted to be capable of performing, for example, blowing operation to drift fallen leaves, refuse and the like together.

2. Description of the Prior Art

As a portable power blower of this type, there has heretofore been employed one which comprises a body and a handle for mounted on the top to the body, the body including an air-cooled two-cycle internal combustion engine as a prime mover, a recoil starter for starting the same, a fuel tank, a centrifugal fan attached to one end of a crankshaft as an output shaft of the engine, and an air inlet formed in front of a fancase of the fan, and which is so constructed that air sucked through the air inlet is blown off via an outlet formed on the fancase and a blow-off pipe connected thereto (see, for example, Japanese Utility Model Laid-open Publication No. 105791/1989).

Such a conventional power blower as mentioned above has the following problems.

(1) The engine, the fancase, the fuel tank or the like included in the body is likely to be damaged when the machine body is, for example, dropped or bumped during transportation, carrying or scavengery; (2) Due to such a structure that the air inlet directly opens to the outside, loud noise (in particular air suction noise) is caused; (3) There is undesired possibility that clothing or the like is sucked into the air inlet during operation; and (4) Although it is portable, its carrying style is practically restricted only to a hand-held style, and accordingly, a separate attachment is awkwardly required in order to adopt a back-packing style.

SUMMARY OF THE INVENTION

In view of these points, it is an object of the present invention to provide a portable power blower which is adapted to prevent damage due to dropping or bumping, lower noise, prevent clothing from being sucked into the air inlet during operation, and yet provide a back-packing carrying style to be readily adopted according to need.

To attain the above-mentioned objects, the portable power blower according to the present invention has a general structure in which a handle is mounted on the top of a body including a prime mover, a fancase (volute chamber) and the like, a fan is attached to one end of an output shaft of the prime mover, and an air inlet is formed in front of the fan.

The portable power blower according to the present invention is characterized in that a main guard member is so mounted as to cover one side on which the air inlet of the fancase (volute chamber) is formed, and that a gap for radially introducing external air into the air inlet is defined between the main guard member and the above-mentioned side.

In the portable power blower of the present invention as described above, it is preferred that, in addition to the main guard member, a sub guard member and a bottom guard member be so mounted as to cover the other side, which is opposite to the side of the body on which the air inlet is formed, and the bottom of the prime mover, respectively.

Further, it is desirable to form the rear side of the main guard member which faces the air inlet into a conical mound whose summit is located on the axis of the output shaft.

In the portable power blower according to the present invention which is constructed as described above, since the body is provided with the guard member, the body is effectively prevented from suffering damage due to dropping, bumping or the like. Further, since the main guard member is mounted in such a manner that it covers the air inlet, suctional noise and the like which are scattered to the outside are lowered, and clothing is prevented from being sucked in, so that improved safety is attained. Moreover, by attaching (a) strap(s) for back-packing (not shown) to the main guard member, it is possible to adopt back-packing carrying style without any separate attachment, which is extremely convenient.

Besides, by providing the sub-guard member and the bottom guard member, it is ensured to prevent the body from being damaged, and noise is reduced further. Moreover, since the rear side of the main guard member is formed into a conical mound whose summit is located at a point through which the axis of the crankshaft passes, air introduced from the outside into the air inlet flows smoothly, thereby enabling air suction noise to be reduced further.

DESCRIPTION OF THE PREFERRED EMBODIMENT

Figure 1:
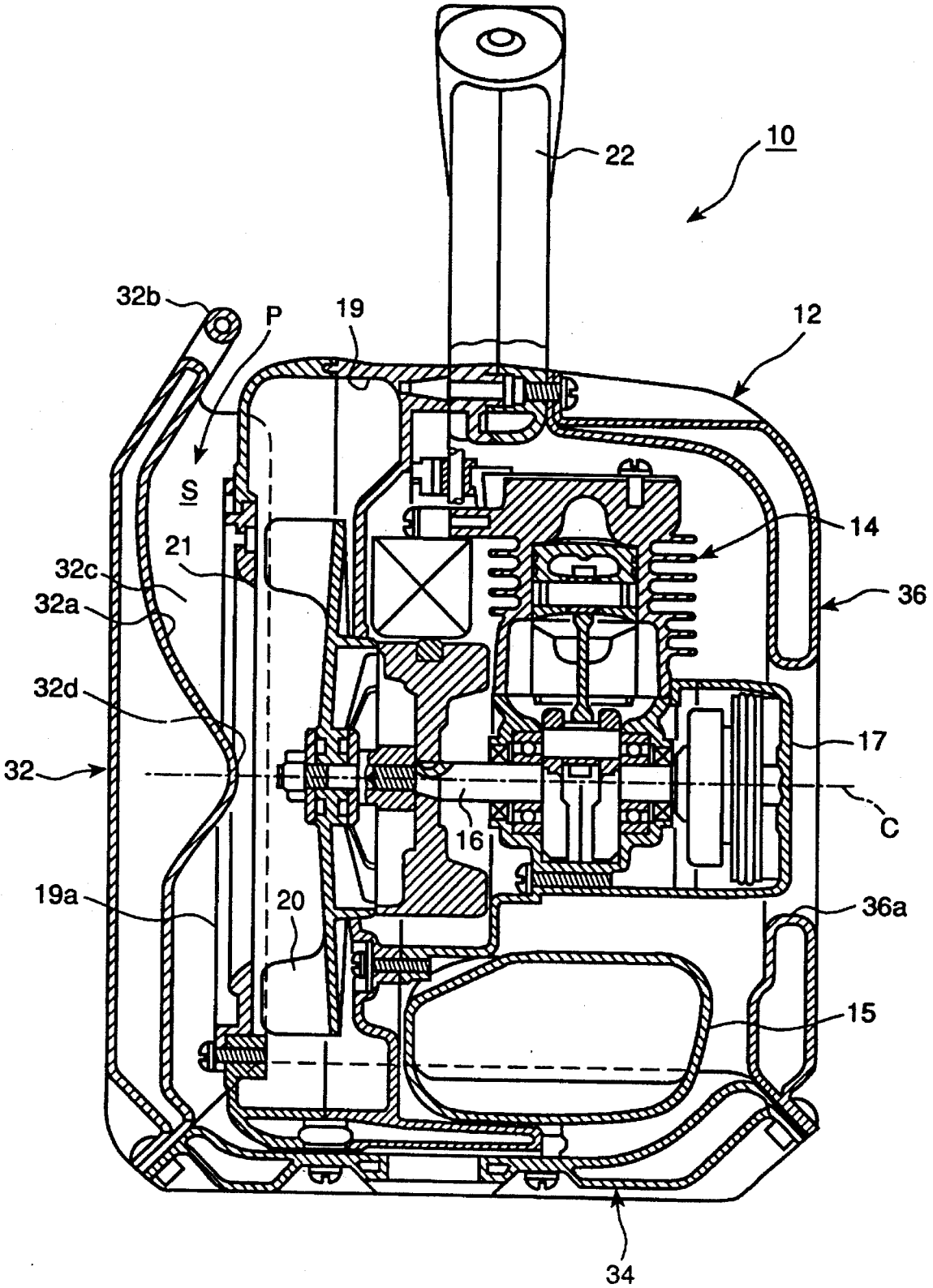
FIG. 1 is a schematic vertical cross-section of one embodiment of the portable power blower according to the present invention.
Figure 2:
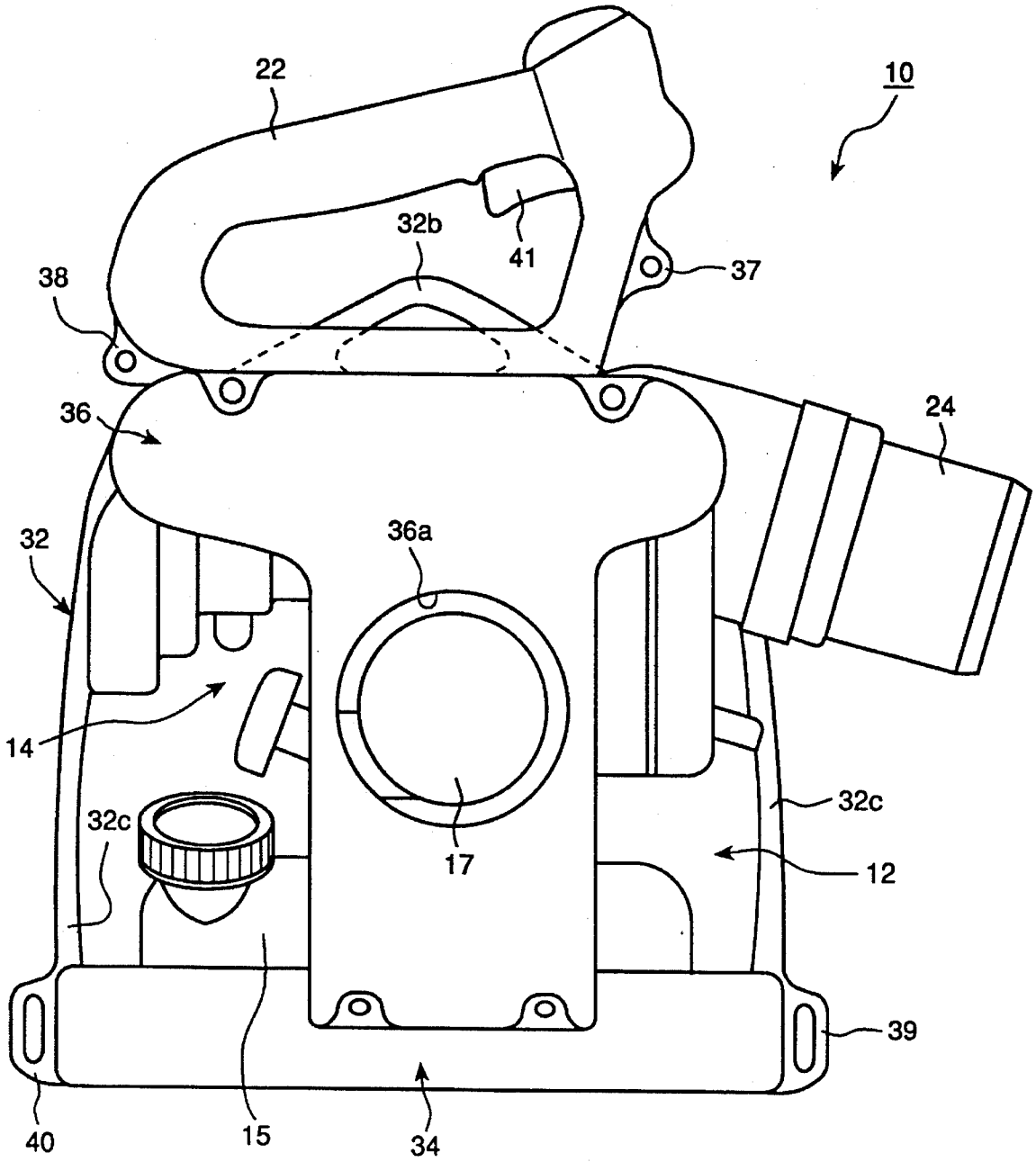
FIG. 2 is a diagrammatic rear elevation of the embodiment in FIG. 1.

FIGS. 1 and 2 show one embodiment of the portable power blower according to the present invention. The portable power blower 10 of this embodiment comprises, like the above mentioned conventional one, a body 12 including an air-cooled two-cycle internal combustion engine 14 as a prime mover, a recoil starter 17 for starting the same, and a fancase (volute chamber) 19 of a centrifugal fan 20 directly connected to and driven by the engine 14. On the top of the body 12 is mounted a handle 22 for hand-holding, and a centrifugal fan 20 is attached to one end of a crankshaft 16 as an output shaft of the engine 14, and an air inlet 21 is formed on the fancase 19 in front of the fan 20, and air sucked through the air inlet 21 is blown off via the volute chamber 19 of the fan 20 which is so formed as to surround the fan 20 of the body 12, an outlet 24 (FIG. 2) and a blow-off pipe (not shown) connected thereto.

In addition to such a construction, a main guard member 32, which is made of a synthetic resin and hollowly formed so as to have preferable cushioning properties, is so mounted as to cover a side surface 19*a* of the body 12 in which the air inlet 21 is formed, a gap S for radially introducing external air into the air inlet 21 is defined between the main guard member 32 and the side surface 19*a* of the fan volute chamber 19, and as shown by arrow P in FIG. 1, external air is introduced by the rotation of the fan 20 through the gap S formed between the outer surface of the volute chamber 19 and the rear side 32*a* of the main guard member 32, and the air is blown off through the volute chamber 19, the outlet 24 and the blow-off pipe to the outside.

The rear side 32*a* of the main guard member 32 is configured into a gently-sloping conical mound whose summit 32*d* is located on the axis C of the crankshaft 16 and which protrudes toward the center of the air inlet 21, and the main guard member 32 is integrally formed with side cover members 32*c*, 32*c* at its both right and left sides, which sidewise cover the volute chamber 19 with the gap S therebetween.

In addition to the main guard member 32, a sub-guard member 36 and a bottom guard member 34 which are made of a synthetic resin and hollowly formed are so mounted as to cover the side, which is opposite to the side of the body 12 in which the air inlet 21 is formed, and the bottom of the engine 14, a fuel tank 15 etc., respectively. The sub-guard member 36 is substantially I-shaped or sidelong-laid H-shaped, and in the mid-portion thereof is formed an opening 36*a* to cause the recoil starter 17 to be exposed to the outside.

In the portable power blower 10 of this embodiment which is constructed as described above, since the guard member 32 is mounted on the body 12, the body 12 is effectively prevented from suffering damage by dropping, bumping or the like. Further, since the main guard member 32 is mounted in such a manner that it covers the air inlet 21, noise which is scattered to the outside (in particular air suction noise caused by the fan 20) is lowered, and clothing is prevented from being sucked in and, as a result, improved safety is attained. Moreover, by attaching (a) strap(s) for back-packing (not shown) to the upper end 32*b* of the main guard member 32 and brackets 39, 40 formed at the right and left ends of the lower end of the main guard member 32, it is possible to adopt back-packing carrying style without any separate attachment, which is extremely convenient.

Besides, by providing the sub-guard member 36 and the bottom guard member 34 which circumferentially cover the body 12, it is ensured to prevent the body 12 from being damaged, and noise which is scattered to the outside (in particular noise caused by the engine 14) is reduced. Further, since the rear side 32*a* of the main guard member 32 is formed into a conical mound whose summit 32*d* is located at a point through which the axis C of the crankshaft 16 passes, air introduced from the outside into the air inlet 21 flows smoothly, thereby enabling air suction noise to be further lowered.

Furthermore, as shown in FIG. 2, it is more advantageous to form brackets 37 and 38 for attaching shoulder straps at the front and the rear of the handle 22 for hand-holding. Incidentally, reference number 41 represents a throttle trigger which controls rotation of the engine 14. In this connection, an electric motor may be used as a prime mover.

As is understood from the above description, according to the portable power blower of the present invention, a variety of effects can be obtained by virtue only of attachment of (a) relatively simple structural member(s). That is, since the portable power blower according to the present invention is circumferentially provided with (a) Guard member(s) in a specific configuration, damage due to dropping or bumping is effectively prevented, and noise is reduced, and clothing is prevented from being sucked in during operation, and yet it is possible to adopt back-packing carrying style according to need.

What is claimed is:

1. A portable power blower comprising: a body and a handle mounted on a top of said body, said body including a prime mover, a fan volute chamber, a fan housed in said fan volute chamber and attached to one end of an output shaft of said prime mover, and an air inlet of said fan volute chamber formed in front of said fan;

said blower further including an outer guard structure including a main guard member mounted to said body so as to cover one side surface of said fan volute chamber on which said air inlet is formed, and spaced therefrom to define a gap between a rear side of said main guard member and said one side surface for radially introducing external air into said air inlet, said gap being in open communication with the atmosphere at a top portion of said body;

a bottom guard member connected to said main guard member and said fan volute chamber so as to cover the bottom portion of said fan volute chamber and said prime mover, and a sub-guard member connected to said bottom guard member and said fan volute chamber so as to cover the sides of said prime mover which oppose said main guard member and said bottom guard member, respectively.

2. The portable power blower according to claim 1, wherein the rear side of said main guard member facing said air inlet is formed into a conical mound whose summit is located on an axis of said output shaft.

* * * * *